US011360410B2

(12) United States Patent
Ishimoto et al.

(10) Patent No.: US 11,360,410 B2
(45) Date of Patent: Jun. 14, 2022

(54) IMAGE FORMING APPARATUS HAVING A TWO DIRECTION ROTATABLE STIRRING MEMBER

(71) Applicant: CANON KABUSHIKI KAISHA, Tokyo (JP)

(72) Inventors: Mizuki Ishimoto, Shizuoka (JP); Masatoshi Itoh, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/226,253

(22) Filed: Apr. 9, 2021

(65) Prior Publication Data

US 2021/0318643 A1 Oct. 14, 2021

(30) Foreign Application Priority Data

Apr. 13, 2020 (JP) ..... JP2020-071578

(51) Int. Cl.
*G03G 15/08* (2006.01)
*G03G 21/16* (2006.01)

(52) U.S. Cl.
CPC ..... *G03G 15/0889* (2013.01); *G03G 21/1647* (2013.01)

(58) Field of Classification Search
CPC ..... G03G 15/0889; G03G 21/1647
See application file for complete search history.

(56) References Cited

U.S. PATENT DOCUMENTS

2020/0117119 A1* 4/2020 Mase ..... G03G 15/0889

FOREIGN PATENT DOCUMENTS

JP 2017-067943 A 4/2017

* cited by examiner

*Primary Examiner* — Sandra Brase
(74) *Attorney, Agent, or Firm* — Venable LLP

(57) ABSTRACT

An image forming apparatus includes a toner storing portion, a stirring member that stirs the toner by rotating inside the toner storing portion, a driving unit for rotating the stirring member in a first rotation direction and in an opposite second rotation direction. A control portion controls the motor such that a rotation direction of the stirring member is changed from the first rotation direction to the second rotation direction, and a detection unit that detects a rotation state of the motor, wherein the control portion determines whether to end the rotating operation or not based on the rotation state detected by the detection unit, and wherein the rotation state includes a rotation speed or a rotation amount of the motor.

19 Claims, 7 Drawing Sheets

FIG.4 TIMING CHART

IMAGE FORMING APPARATUS HAVING A TWO DIRECTION ROTATABLE STIRRING MEMBER

BACKGROUND OF THE INVENTION

Field of the Invention

The present invention relates to a toner loosening control method in an image forming apparatus.

Description of the Related Art

In a case where a new toner cartridge is installed in an image forming apparatus and toner is solidified inside this toner cartridge, the toner may not be conveyed by a toner conveying portion, such as a toner conveying screw, and this has been a problem. An example of solving this problem is Japanese Patent Application Publication No. 2017-067943, which relates to a method of controlling the toner loosening operation in an image forming apparatus, and discloses the toner loosening operation performed by rotating a toner conveying screw in a forward rotation and a backward rotation as a set, and repeating this set of rotations for a plurality of times.

SUMMARY OF THE INVENTION

However, in the case of performing the toner loosening operation by a control method disclosed in Japanese Patent Application Publication No. 2017-067943, the toner loosening operation ends only when a predetermined number of sets of the forward rotation and the backward rotation is completed. Therefore, even if the toner is sufficiently loosened actually in the middle of the toner loosening operation, the user has to wait until the rest of the predetermined sets of operation is completed. As a result, the toner loosening operation takes more time than necessary, and usability drops.

With the foregoing in view, it is an object of the present invention to provide a technique that quickly completes the toner loosening operation and reduces the time that the user waits for completion of the toner loosening operation.

In order to achieve the above object, an image forming apparatus according to the present invention includes:

a toner storing portion that stores toner;

a stirring member that stirs the toner by rotating inside the toner storing portion;

a driving unit that includes a motor and is capable of rotating the stirring member in a first rotation direction and in a second rotation direction, which is an opposite direction to the first rotation direction, by a driving force of the motor; and a control portion that controls the motor to perform a rotating operation to rotate the stirring member; and a detection unit that detects a rotation state of the motor, wherein the control portion determines whether to end the rotating operation or not based on the rotation state detected by the detection unit.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiments of the present invention will be described. The following embodiments are examples, and are not intended to limit the scope of the present invention to the embodiments alone.

Embodiment 1

In a toner loosening operation described in Embodiment 1 below, whether the toner is loosened or not is determined based on the rotation speed of a motor which drives a toner stirring screw in the forward rotation and the backward rotation, and based on this determination result, the toner stirring screw is controlled.

General Configuration of Image Forming Apparatus

Figure 1:
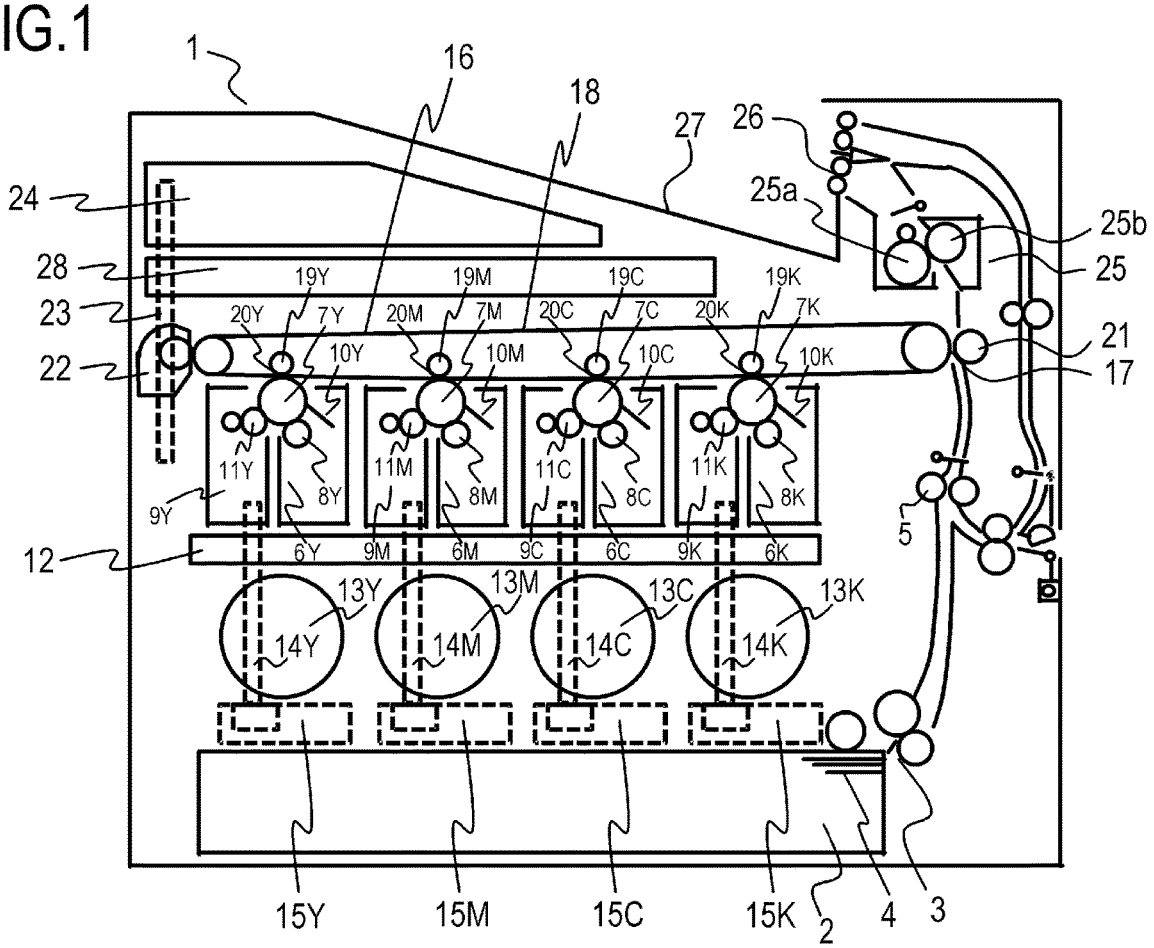
FIG. 1 is a diagram depicting an example of a general configuration of an image forming apparatus according to Embodiment 1.

A general configuration of an electrophotographic type image forming apparatus, to which the present embodiment can be applied, will be described. FIG. 1 is a principal cross-sectional view depicting a general configuration of the image forming apparatus 1.

Paper Feeding

In a lower portion of the image forming apparatus 1, a cassette 2 is drawably stored. A cassette paper feeding portion 3 is disposed near the edge of the cassette 2. Recording materials 4 are stacked in the cassette 2 so that the recording materials are separated one-by-one and fed to a resist roller 5.

Image Forming Portion

The image forming apparatus 1 includes an image forming portion 6 in which image forming stations 6Y, 6M, 6C and 6K, which correspond to colors yellow, magenta, cyan and black respectively, are disposed in a line horizontally.

Inside the image forming portion 6, photosensitive drums 7Y, 7M, 7C and 7K (hereafter photosensitive drums 7) which are image bearing members, charging apparatuses 8Y, 8M, 8C and 8K (hereafter charging apparatuses 8) which uniformly charge the surface of the photosensitive drums 7, developing apparatuses 9Y, 9M, 9C and 9K (hereafter developing apparatuses 9) which develop a toner image by attaching toner to an electrostatic latent image, and photosensitive member cleaning blades 10Y, 10M, 10C and 10K (hereafter photosensitive member cleaning blades 10) which remove residual toner remaining on the photosensitive drums 7, are disposed.

In the developing apparatuses 9, developing rollers 11Y, 11M, 11C and 11K (hereafter developing rollers 11), corresponding to each color, are disposed respectively, so as to contact with or separate from the respective photosensitive drums 7. By the developing rollers 11 contacting with or separating from the respective photosensitive drums 7 in accordance with the electrostatic latent image, the life of the developing rollers 11 can be improved.

A scanner unit 12, which forms an electrostatic latent image on the photosensitive drum 7 by irradiating a laser beam based on the image information, is disposed below the image forming portion 6.

Between the scanner unit 12 and the cassette 2, toner cartridges 13Y, 13M, 13C and 13K (hereafter toner cartridges 13) are disposed approximately horizontally. Inside each toner cartridge 13, replenishing toner corresponding to each color is filled.

Toner conveying apparatuses 14Y, 14M, 14C and 14K (toner conveying apparatuses 14) convey toner received from the respective toner cartridges 13 upward, so as to supply toner to the developing apparatuses 9. The toner conveying apparatuses 14 are driven by toner conveying driving apparatuses 15Y, 15M, 15C and 15K (hereafter toner conveying driving apparatuses 15) disposed below the toner conveying apparatuses 14.

A toner cartridge detection sensor (not illustrated) is disposed for each color to detect that each toner cartridge 13 is installed in the image forming apparatus, so that installation or removal of each toner cartridge 13Y, 13M, 13C and 13K can be detected.

Transfer

An intermediate transfer unit 16 is disposed above the developing apparatuses 9. The intermediate transfer unit 16 is disposed approximately horizontally with the secondary transfer portion 17 side down. An intermediate transfer belt 18, which faces each photosensitive drum 7, is a rotatable endless belt, and is stretched around a plurality of stretching rollers.

On the inner surface of the intermediate transfer belt 18, primary transfer rollers 19Y, 19M, 19C and 19K (hereafter primary transfer rollers 19), which are primary transfer members, are disposed respectively at positions where primary transfer portions 20Y, 20M, 20C and 20K (hereafter primary transfer portion 20) can be formed with the respective photosensitive drums 7 via the intermediate transfer belt 18. In each primary transfer portion 20, a toner image is transferred from each photosensitive drum 7 to the intermediate transfer belt 18 by the corresponding primary transfer roller 19 to which voltage is applied.

In Embodiment 1, the intermediate transfer unit 16 is a unit constituted of the intermediate transfer belt 18, the plurality of stretching rollers to stretch the intermediate transfer belt 18, and each primary transfer roller 19, and can be attached to/detached from the apparatus main body.

A secondary transfer roller 21, which is a secondary transfer member, contacts with the intermediate transfer belt 18, and forms a secondary transfer portion 17 with a roller on the opposite side via the intermediate transfer belt 18. In the secondary transfer portion 17, the toner image transferred on the intermediate transfer belt 18 is secondarily transferred to the recording material 4. Toner which is not transferred to the recording material 4 in the secondary transfer and remains on the intermediate transfer belt 18 is removed by a cleaning unit 22. The toner removed by the cleaning unit 22 is conveyed to a toner collection container 24 via a toner conveying portion 23, and is stored in the toner collection container 24.

Fixing, Paper Delivery

Then the recording material 4 is conveyed to a fixing apparatus 25, and passes through a nip formed by a heating unit 25*a* disposed inside the fixing apparatus 25 and a pressure roller 25*b* which is pressed against the heating unit 25*a*. The recording material 4 which passed through the fixing apparatus 25 is conveyed to a discharging roller pair 26, and is discharged into a recording material stacking portion 27.

Power Supply Apparatus

On the rear surface side of the image forming apparatus 1, a low voltage power supply apparatus (not illustrated), which supplies voltage to a control portion including various motors, fans and solenoids inside the image forming apparatus 1, is disposed, and in a space between the intermediate transfer belt 18 and the toner collection container 24, a high voltage power supply apparatus 28, which applies high voltage to the charging apparatuses 8, the developing apparatuses 9, the primary rollers 19, the secondary roller 21, and the like, is disposed.

Control Portion

Further, in the image forming apparatus 1, a control portion (not illustrated) equipped with an MPU, including a CPU and the like, is disposed, and controls the operation of the image forming apparatus 1 in total, such as a control related to the image forming operation, including control of the drive source related to the toner loosening operation. Furthermore, an operation panel (not illustrated), to display the status of the image forming apparatus 1 to the user, is disposed.

General Configuration of Toner Cartridge

Figure 2A:
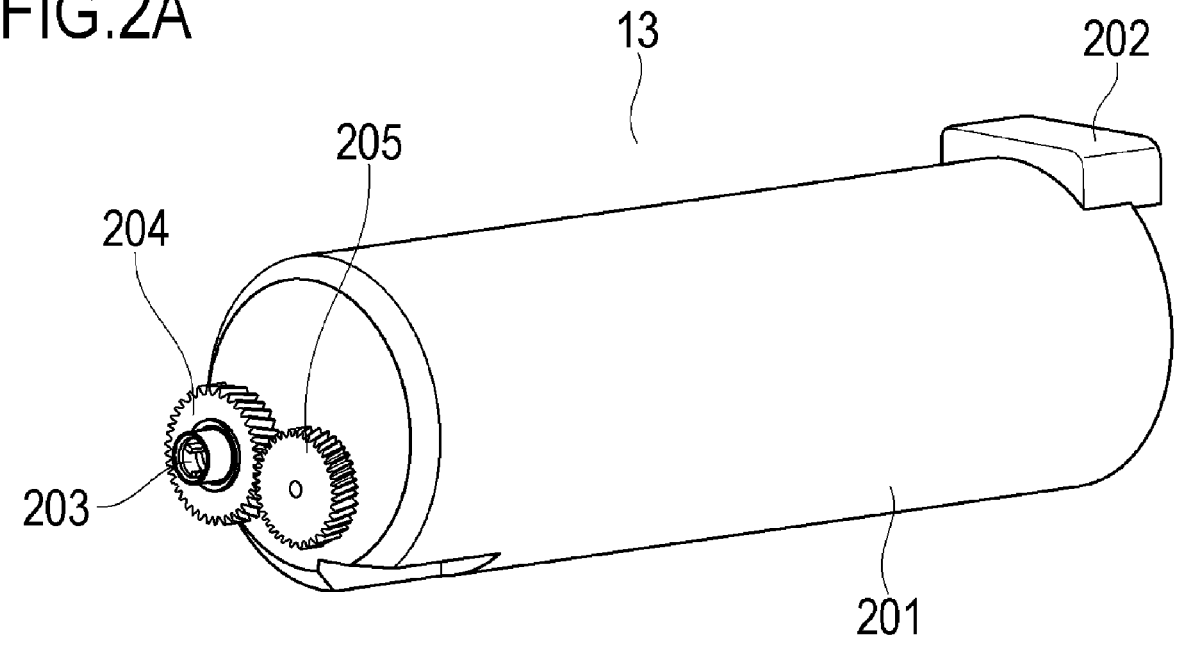
FIGS. 2A and 2B are diagrams illustrating an example of a toner cartridge according to Embodiment 1.
Figure 2B:
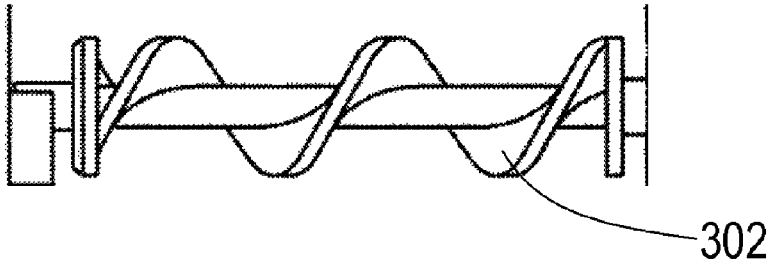

The general configuration of the toner cartridge 13 in Embodiment 1 will be described. FIGS. 2A and 2B indicate perspective views when the toner cartridge 13 is viewed from the rear side, and an illustration of a toner stirring screw 302. As illustrated in FIG. 2A, the toner cartridge 13 has a container main unit 201 which is approximately cylindrical in the longitudinal direction, and stores toner inside the container main unit 201. In the description on the present embodiment, the shape of the container main unit 201 is approximately cylindrical, but the container main unit 201 is not limited to this shape. For example, the effect of the present invention remains unchanged even if the shape of the container main unit 201 is a rectangular parallelepiped.

A grip 202 is formed on the front wall of the toner cartridge 13 (toner storing portion). The toner cartridge 13 can be attached to/detached from the image forming apparatus 1 by holding the grip 202. A driven protrusion 203, which is a driving unit, is rotatably disposed on a rear wall of the toner cartridge 13. Further, as indicated in FIG. 2B, a toner stirring screw 302, which is a stirring member to stir the toner using the driving force transferred from the driven protrusion 203, is disposed inside the toner cartridge 13 (inside the toner storing portion). The toner stirring screw 302 has a function as a conveying member to convey the toner.

A gear 204 is integrated with the driven protrusion 203, and the gear 204 transfer power to a gear 205. A replenishing port (not illustrated), through which toner is supplied, is formed on the rear wall side of the lower wall portion of the container main unit 201.

Overview of Operation of Toner Loosening Operation Portion

Figure 3:
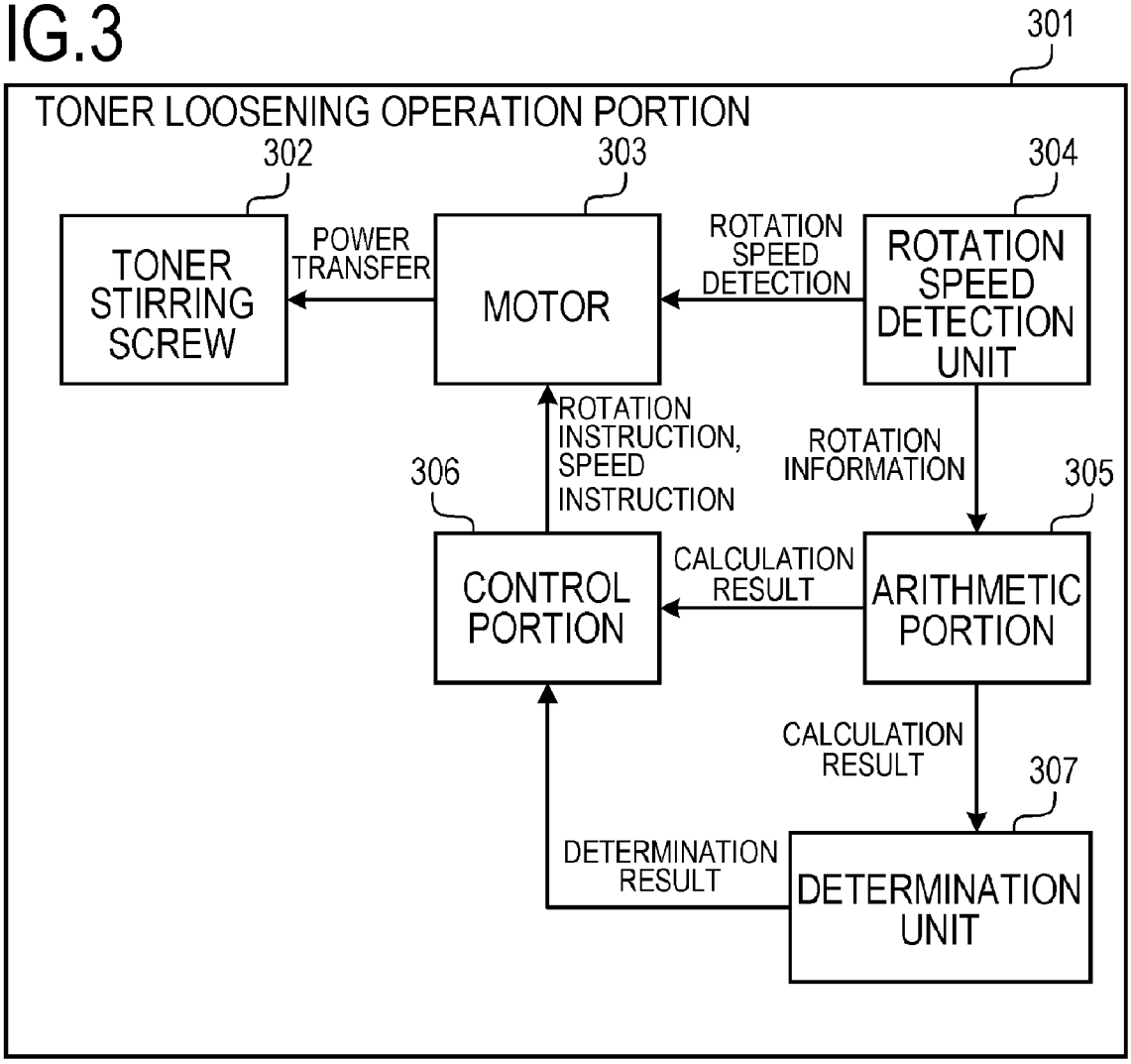
FIG. 3 is a block diagram depicting an example of a configuration of a toner loosening operation portion according to Embodiment 1.

An overview of the operation of the toner loosening operation (a rotating operation, a stirring operation, a first operation) according to Embodiment 1 will be described. FIG. 3 is a block diagram of the toner loosening operation portion 301 in the image forming apparatus 1. The toner loosening operation portion 301 includes a toner stirring screw 302, a motor 303, a rotation speed detection unit 304, an arithmetic portion 305, a control portion 306 and a determination unit 307.

The toner stirring screw 302 is disposed inside the toner cartridge 13, and stirs the toner. The motor 303 transfers the driving force in the forward rotation, i.e., first rotation direction, and the backward rotation, i.e., second rotation direction, to the toner stirring screw 302 via a driving gear and a connecting member. The motor 303 used in the present embodiment is a DC brushless motor. The motor that can be used here is not limited to this, and a stepping motor, for example, may be used.

The rotation speed detection unit 304 detects the rotation speed of the motor 303. In Embodiment 1, the rotation speed is detected using a frequency generator (FG) signal outputted from a driver IC that drives the motor 303. The arithmetic portion 305 calculates and determines the rotation speed based on the rotation information acquired from the rotation speed detection unit 304. To perform speed control, the calculation result is fed back to the control portion 306. Based on the rotation speed acquired from the arithmetic portion 305 and the elapsed time since the start of rotation of the motor 303, the determination unit 307 determines whether the rotation of the motor 303 is continued, or the rotation direction thereof is reversed, or the toner loosening operation is ended.

Based on the calculation result acquired from the arithmetic portion 305 and the determination result acquired from the determination unit 307, the control portion 306 instructs the start or stop operation of the motor 303, the direction of the rotation, or the speed of the rotation. In Embodiment 1, the rotation of the motor 303 is controlled based on the pulse width modulation (PWM), and power to be supplied to the motor increases as the speed and load of the rotation increase. Therefore, in the case where a rotation load exceeding the maximum torque that the motor 303 can output is applied, the motor 303 cannot reach the target rotation speed.

Timing Chart

A sequence of the toner loosening operation according to Embodiment 1 will be described with reference to a timing chart in FIG. 4. The abscissa indicates the time (sec.), and the ordinate indicates the rotation speed (rpm) of the motor 303, and the rotation speed is indicated by the + (plus) sign in the case of the forward rotation, and with the − (minus) sign in the case of the backward rotation. To assist in explanation, the rotation control of the motor 303 in the toner loosening operation is divided into phases (a) to (d).

Figure 4:
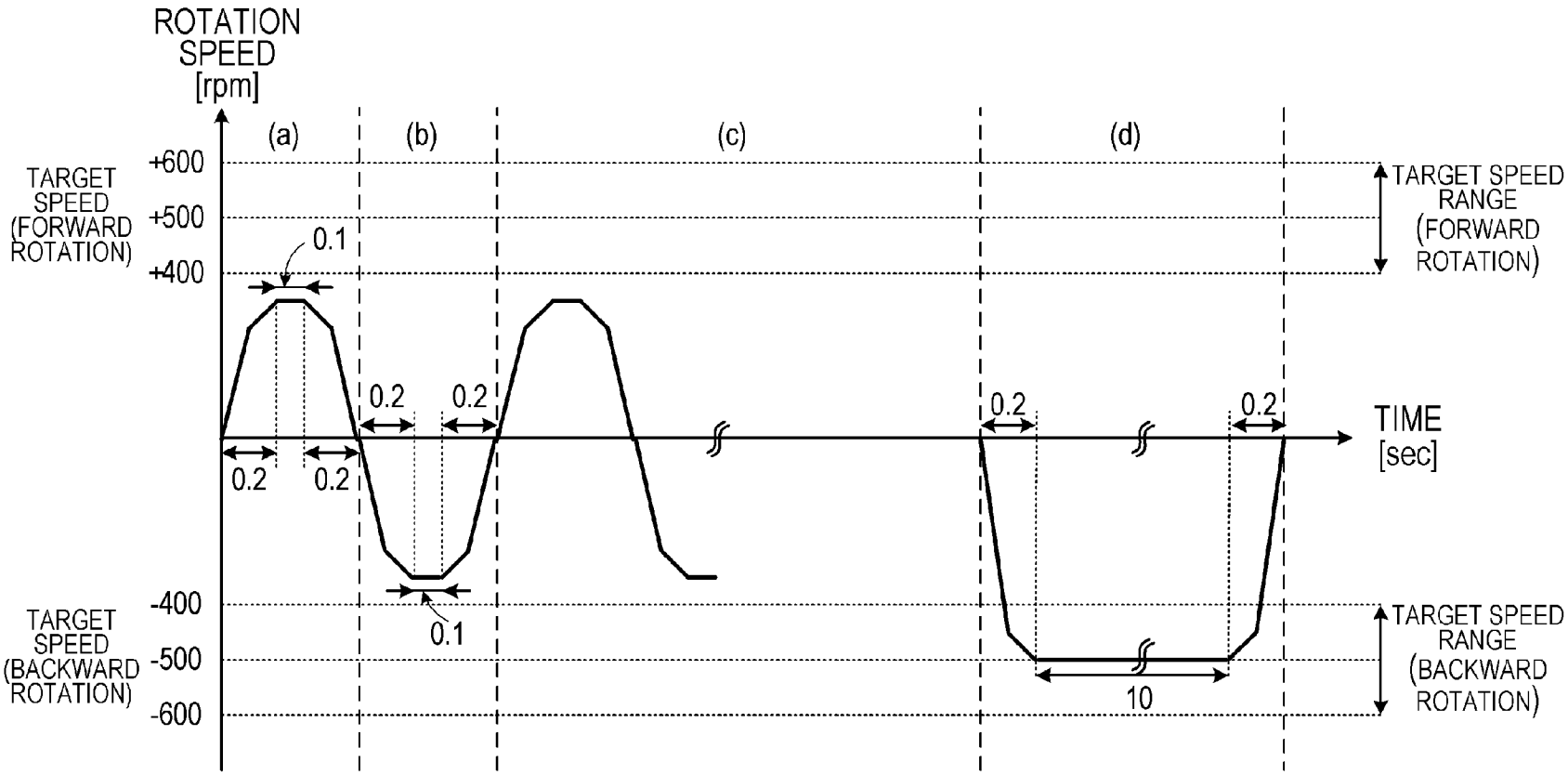
FIG. 4 is a timing chart of a toner loosening operation according to Embodiment 1.

The time and set values required for the motor control indicated in FIG. 4 differ depending on such conditions as the torque needed for the motor and toner loosening, and are not intended to limit the time and set values in Embodiment 1. Further, in Embodiment 1, the rotation state of the motor 303 in the toner loosening operation is controlled based on the rotation speed, but the present invention is not limited to this, and the rotation control may be performed based on the rotation amount of the motor 303, for example.

(a)

First the motor 303 is started to drive in the forward rotation. Here the toner loosening operation is started with the forward rotation, but may be started with the backward rotation. In other words, the motor 303 is started to drive in either the forward rotation or the backward rotation, so as to rotate the toner stirring screw 302. Then the motor 303 is continuously rotated for 200 msec., i.e., startup time, from the start of driving until the motor 303 is started. The startup time refers to the time required for the motor 303 to reach the target speed from the start, and is preferably set to an average time required for the motor 303 to reach the target speed from the start in the case where the toner in a new toner cartridge 13 is sufficiently loosened. In Embodiment 1, the target speed is assumed to be 500 rpm.

Generally when the rotation speed of the motor is decreased, the maximum torque that the motor can output increases. Since the load applied to the motor 303 is large when the toner is solidified, it is preferable that the target speed of the motor 303 is low during the toner loosening operation. However, if the rotation speed is low, the toner loosening operation takes time, hence the optimum speed must be set considering both the time required for the toner loosening operation and the abovementioned maximum torque that the motor 303 can output.

When the startup time has elapsed since the start of driving of the motor 303, the rotation speed detection unit 304 starts detecting the rotation speed of the motor 303, and controls the motor using the detection unit 307. In the case where the state of the rotation speed of the motor 303 that is outside the predetermined target speed range continues at least for a predetermined period, i.e., 100 msec., the stirring of toner by the toner stirring screw 302 is insufficient. Therefore, the determination unit 307 determines that the toner is not being loosened efficiently, and stops the motor 303. The motor 303 is also stopped if the state of the rotation speed of the motor 303 that is outside the target speed range continues at least for a predetermined period, i.e., 100 msec., even after the target speed is once reached.

The abovementioned target speed range refers to a speed range that is set in advance to determine whether the rotation speed of the motor 303 reached the target temperature. Here the target speed range is set from 400 rpm (lower limit) to 600 rpm (upper limit), while the target speed is 500 rpm. In other words, it is determined that the motor 303 is rotating at the target speed of 500 rpm if the rotation speed of the motor 303 is in the range of 400 rpm to 600 rpm.

Generally when the toner is not loosened, the load applied to the motor increases, hence the rotation speed of the motor does not reach the target speed quickly. As the toner is loosened, the load applied to the motor decreases, and the rotation speed of the motor reaches the target speed more quickly.

In this way, the evaluation standards to determine whether the toner is being loosened efficiently or not are: the setting of the target speed range; and the setting of the limit of the time duration (msec.) of the state that is outside the target speed range to determine that the speed of the motor is not the target speed.

In Embodiment 1, the target speed range is used to determine whether the rotation speed of the motor 303 reached the target speed, but only the lower limit speed may be specified for this determination.

(b)

Then the driving of the motor 303 in the stopping state is started again in the backward rotation. When the startup time has elapsed since the start of driving, it is determined whether the state that is outside the target speed range is continuing at least for 100 msec or not. The motor 303 is stopped again if the state is continuing for at lease for 100 msec.

(c)

Driving of the motor 303 that is stopped is started again in the forward rotation. In the case where the state that is outside the target speed range continues for at least 100 msec., i.e., predetermined period, like this, the motor 303 is stopped, the rotation direction is reversed, and the operation to drive the motor 303 is performed in the opposite direction, and this operation is repeated alternately. In Embodiment 1, the control in the forward rotation or in the backward rotation is tried 20 times at the maximum. In the case of performing the rotation control based on the rotation amount of the motor 303, the rotation direction of the motor is changed alternately until a predetermined rotation amount is maintained.

(d)

In the case where the state that is outside the target speed range does not continue at least for 100 msec., it is determined that the toner stirring screw 302 is stirring toner efficiently, and the current rotation is maintained without reversing the rotation direction of the motor 303. In Embodiment 1, a case of maintaining the backward rotation is indicated, but the same control is performed in the case of the forward rotation as well.

If a state of maintaining a certain rotation direction continues at least for 10 msec., i.e., predetermined period, after the startup time has elapsed since the start of driving of the moor 303, it is determined that a predetermined rotation speed is maintained, and toner is sufficiently loosened, and the motor 303 is stopped and the toner loosening operation is ended. In the case of performing the rotation control based on the rotation amount of the motor 303, it may be determined that at least a predetermined rotation amount is maintained and toner is sufficiently loosened if the state of the maintaining a certain rotation direction continues for a predetermined period, and then the motor 303 may be stopped.

Flow Chart

Figure 5:
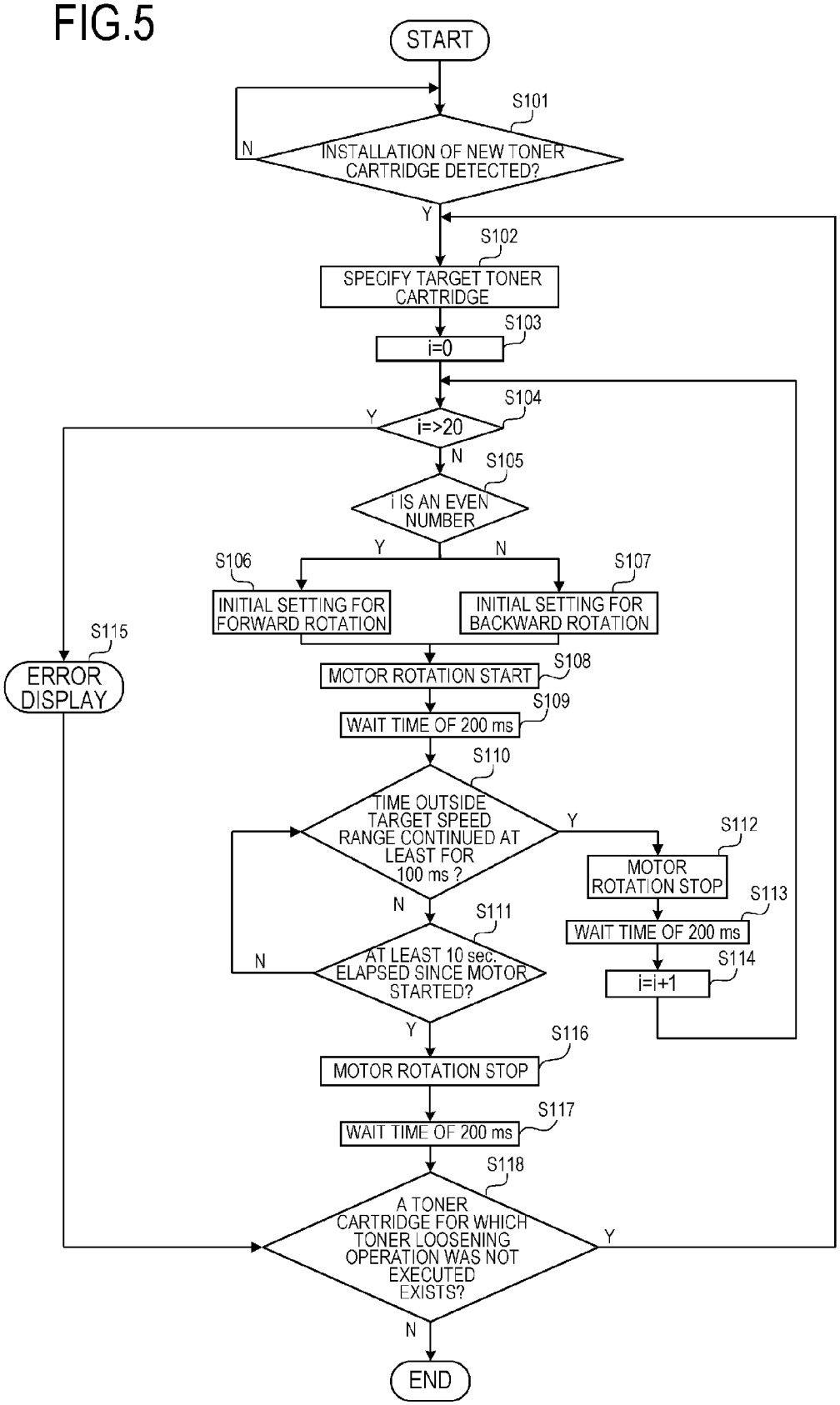
FIG. 5 is a flow chart depicting a sequence of the toner loosening operation according to Embodiment 1.

A sequence of the toner loosening operation in Embodiment 1 will be described with reference to the flow chart in FIG. 5.

When the sequence of the toner loosening operation starts, it is determined whether installation of a new toner cartridge 13 is detected (S101). If installation is detected, the target toner cartridge 13 of the toner loosening operation is specified (S102), and a number of rotation trials of the motor 303 in this sequence is initialized to 0 (S103).

Then it is determined whether the number of rotation trials is at least 20 times (S104). The processing flow advances to S115 if the number of rotation trials is at least 20 times, or advances to S105 if less than 20 times. In S105, it is determined whether a current number of rotation trials of the motor 303 is an even number. An initial setting for the forward rotation is performed if the number of rotation trials is an even number (S106), or an initial setting for the backward rotation is performed if an odd number (S107).

In the initial setting, the rotation direction and the rotation speed are set. Since the number of rotation trials is 0 immediately after initialization, the initial setting for the forward rotation is performed here. Then the motor 303 is started up and the forward rotation is started (S108). When 200 msec. has elapsed since the motor 303 started driving (S109), it is determined whether the time when the rotation speed is outside the target speed range continued at least for 100 msec. by comparing the rotation speed of the motor 303 and the target speed (S110).

The processing flow advances to S112 if the time that is outside the target speed range continued at least for 100 msec., or to S111 if not continued at least for 100 msec.

If the time that is outside the target speed range continued at least for 100 msec., the rotation stop is instructed to the motor 303 (S112), and when 200 msec., which is required for a complete stop of the motor 303, has elapsed (S113), the number of rotation trials is incremented by 1 (S114), and the processing flow returns to S104.

If the number of rotation trials, as a result of an increment, is at least 20 in S104, it is determined that toner is not loosened sufficiently, and an error message, to notify the user that the toner loosening of the target toner cartridge 13 is insufficient, is displayed on the operation panel of the image forming apparatus 1 (S115). Then it is determined whether a new toner cartridge 13 for which the toner loosening operation has not been executed exists (S118), and if such a toner cartridge 13 exists, the next target toner cartridge 13 is specified (S102), and the toner loosening operation is continuously performed.

If the number of rotation trials is less than 20 in S104, processing flow returns to S105. Since the number of rotation trials is 1 here, the initial setting for the backward rotation is performed (S107). Then the abovementioned processing flow from S108 to S110 is executed.

If the time that is outside the target speed range is not continuing at least for 100 msec. in S110, it is determined whether at least 10 sec. has elapsed since the end of the startup time after the start of driving of the motor 303 (S111). Processing flow returns to S110 if at least 10 sec. has not elapsed.

If at least 10 sec. has elapsed, it is determined that the toner is sufficiently loosened, and a rotation stop of the motor 303 is instructed (S116). When 200 msec., which is required for a complete stop of the motor 303, has elapsed (S117), it is determined whether a new toner cartridge 13 for which the toner loosening operation has not been executed exists (S118). If it exists, processing flow returns to S102, and the next target toner cartridge 13 of the toner loosening operation is specified.

The abovementioned processing flow in S103 to S118 is repeated for all the new toner cartridges 13 that are installed. If a new toner cartridge for which the toner loosening operation has not been executed does not exist in S118, it is determined that the toner loosening operation is completed for all the toner cartridge 13, and this sequence ends.

As described above, according to Embodiment 1, it is determined whether toner is loosened or not based on the rotation speed of the motor 303 when the toner loosening operation is performed. If it is determined that the toner is loosened, the toner loosening operation ends, but if it is determined that the toner is not loosened, the rotation direction of the motor is reversed, whereby the time required for the toner loosening operation can be decreased.

Embodiment 2

Overview

In the toner loosening operation described below in Embodiment 2, whether or not the toner is loosened is determined based on the rotation speed of a motor in a case where the motor is rotating in either the forward rotation direction or the backward rotation direction, and based on this determination result, the toner stirring screw is controlled.

Seal Removal

When a new toner cartridge 13 is actually installed in the image forming apparatus 1, various sequences are performed continuously, and it is rare to perform the toner loosening operation by itself. For example, in Embodiment 2, a seal removal operation (a second operation) is performed immediately after the toner loosening operation of the new toner cartridge 13 is completed. The seal removal operation here refers to a sequence of removing a seal member attached before the toner cartridge 13 is shipped, in order to seal the replenishing port (opening) of the toner cartridge 13 and prevent the toner from leaking through the replenishing port. In Embodiment 2, the seal removal operation is performed by rotating the toner stirring screw 302 in reverse for 10 sec. at a 2000 rpm rotation speed.

In the toner loosening operation, however, it is necessary to prevent the seal member from being wound up and removed from the replenishing port by the rotation operation of the toner stirring screw 302 for loosening the toner. Therefore, in Embodiment 2, the rotation speed of the motor 303 in the toner loosening operation is set to a value that is sufficiently smaller than the rotation speed required for the seal removal operation.

In the case of performing different sequences continuously like this, the rotation direction at the end of the toner loosening operation, which is the first sequence that is performed first, and the rotation direction at the start of the seal removal operation, which is the second sequence that is performed continuously after the first sequence, are set to the same direction, whereby the time required for the control of switching the rotation direction between the first sequence and the second sequence can be decreased. In Embodiment 2, this method will be described.

Timing Chart

Figure 6:
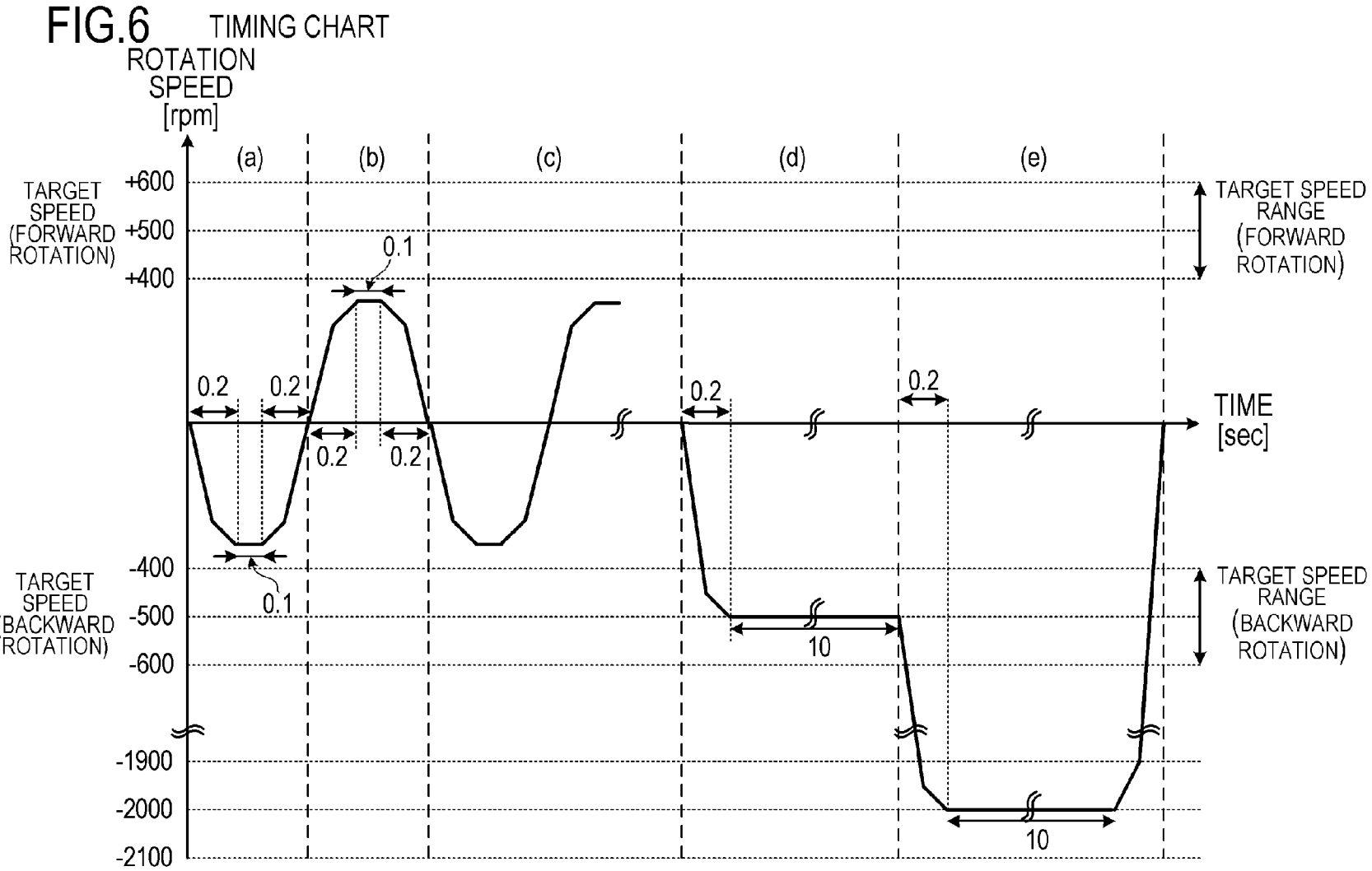
FIG. 6 is a timing cart of a toner loosening operation according to Embodiment 2.

The sequence of the toner loosening operation according to Embodiment 2 will be described with reference to a timing chart in FIG. 6. FIG. 6 is a timing chart in the case where the seal removal operation (e) is continuously performed after the phases (a) to (d) of the toner loosening operation are ended. The set time and the set values in Embodiment 2 are not intended to limit the scope of the patent.

(a)

First the driving of the motor 300 is started. At this time, the first rotation direction at the start of the toner loosening operation is reversed, so that the motor 303 is rotated in the backward direction. This is because the rotation directions at the start and end of the toner loosening operation are set to the same direction, so that in the case where the solidifying degree of toner is small, the toner loosening operation can be ended within the shortest time without reversing the rotation direction at all. Just like Embodiment 1, the target speed of the motor 303 is 500 rpm. The motor 303 is stopped if the time that is outside the target speed range continues at least for 100 msec. after the startup time has elapsed since the start of the driving of the motor 303.

(b)

Then the rotation direction is reversed, and the driving in the forward rotation is started. The forward rotation here is an assist operation to make the toner loosening operation in the backward rotation more efficient, and the control based on the determination unit 307 is not performed. When the startup time of 200 msec. has elapsed since the start of the driving by the motor 303, the forward rotation is performed for 100 msec. at the target speed of 500 rpm, then the motor 303 is stopped. The time to perform this forward rotation at this time is set to the time by which the seal member is not wound up around the rotation shaft of the toner stirring screw 302.

(c)

The driving of the motor 303 in the stopping state is started again in the backward rotation. As mentioned above, if the state that is outside the target speed range continues at least for 100 msec. when the backward operation is performed, the motor 303 is stopped, and then the rotation direction is reversed, and control to perform the assist operation in the forward rotation is repeated alternately. This control in the backward rotation or in the forward direction is tried 20 times at the maximum.

(d)

In the case where the state that is outside the target speed range does not continue at least for 100 msec., the current rotation is maintained without reversing the rotation direction of the motor 303. If the state of maintaining the rotation direction continues for at least 10 sec. after the startup time 200 msec. has elapsed since the start of driving the of motor 303, it is determined that the toner is sufficiently loosened, and the seal removal operation is started.

(e)

The seal removal operation according to Embodiment 2 is set to the same direction as the rotation direction of the motor 303 at the start of the toner loosening operation, then the motor 303 is rotated in the backward rotation direction. Since it is controlled such that the rotation direction at the end of the toner loosening operation always becomes the backward rotation, the seal removal operation can be quickly started without reversing the rotation direction of the motor 303.

Further, the rotation speed of the motor 303 during the seal removal operation is set to 2000 rpm. When the seal removal operation is performed, toner has already been loosened sufficiently, hence the load applied to the motor 303 is lighter than the time when the toner loosening operation is being performed. Therefore, the rotation speed of the motor 303 is set to be higher than the time of the toner loosening operation, so that the seal removal operation can be ended quickly.

When the time 200 msec. has elapsed from the start of the seal removal operation by the motor 303 to reaching the target speed of 2000 rpm, the seal removal operation is performed for 10 sec., then the motor 303 is stopped to end the seal removal operation.

Flow Chart

Figure 7:
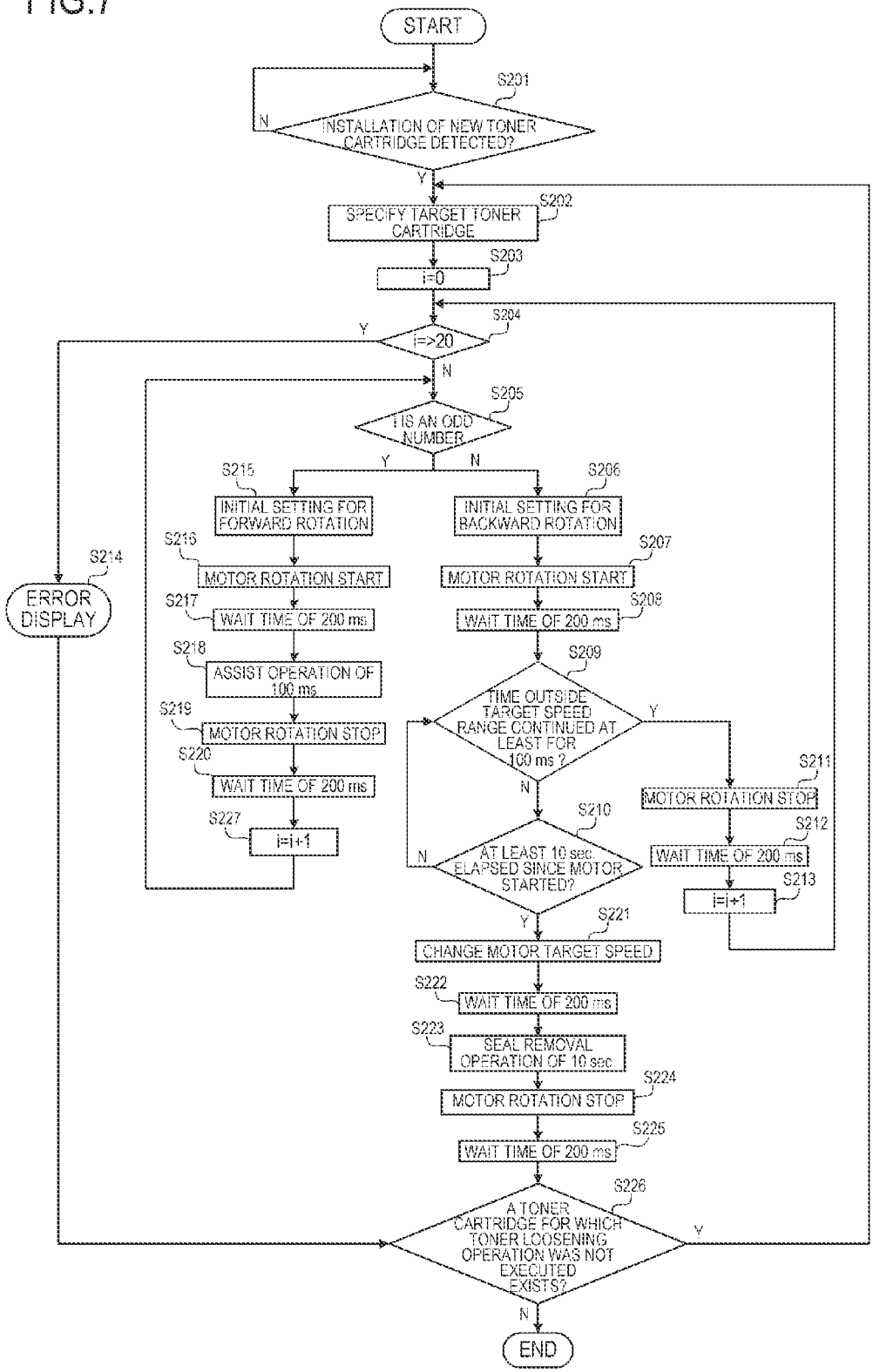
FIG. 7 is a flow chart depicting a sequence of the toner loosening operation according to Embodiment 2.

A sequence of the toner loosening operation and the seal removal operation according to Embodiment 2 will be described with reference to FIG. 7. Description on the content that is the same as in Embodiment 1 will be omitted.

After the toner loosening operation is started, the flow from S201 to S204 is executed. The flow from S201 to S204 is the same as the flow from S101 to S104 in Embodiment 1, hence description thereof will be omitted. Then it is determined whether a number of rotation trials of the motor 303 in this sequence is an odd number (S205). Since the number of rotation trials is 0 immediately after initialization, the initial setting for the backward rotation is performed here (S206). The flow from S206 to S214 in the backward rotation is the same as the flow from S107 to S115 in Embodiment 1.

If the number of rotation trials is an even number in S205, the initial setting for the forward rotation is performed (S215). Then the driving of the motor 303 is started in the forward rotation (S216), and when the startup time of 200 msec. has elapsed (S217), the assist operation is performed (S218). The assist operation here is executed for the predetermined 100 msec., regardless the rotation speed of the motor 303. Then the rotation stop of the motor 303 is instructed (S219), and when the stopping time of 200 msec. has elapsed (S220), the number of rotation trials is incremented by 1 (S227), and the processing flow returns to S205.

If at least 10 sec. has elapsed in S210, the processing flow advances to S221. In S221, the target speed of the motor 303 is changed from 500 rpm to 2000 rpm. That is, it is determined that toner is sufficiently loosened, and the toner loosening operation at low speed rotation shifts to the seal removal operation at high speed rotation.

When the time 200 msec required for the motor 303 to reach the target speed of 2000 rpm has elapsed (S222), the seal removal operation is performed for 10 sec. (S223). Then the rotation stop is instructed to the motor 303 (S224), and when the stopping time of 200 msec. has elapsed (S225), it is determined that the seal removal operation ended, and the processing flow advances to S226. If a toner cartridge 13 for which the toner loosening operation has not been executed does not exist in S226, this sequence ends.

As described above, according to Embodiment 2, the rotation directions of the motor 303 at the start and the end of the toner loosening operation are set to the same directions as the sequence performed after the toner loosening operation, whereby the time required for the toner loosening operation and the sequence performed thereafter can be decreased.

As described above, according to the present invention, the toner loosening operation can be completed quickly, and the time that the user waits for completion of the toner loosening operation can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-071578, filed on Apr. 13, 2020, which is hereby incorporated by reference herein in its entirety.

What is claimed is:

1. An image forming apparatus comprising:

a toner storing portion that stores toner;

a stirring member that stirs the toner by rotating inside the toner storing portion;

a driving unit that includes a motor and is capable of rotating the stirring member in a first rotation direction and in a second rotation direction, which is an opposite direction to the first rotation direction, by a driving force of the motor;

a control portion configured to control the motor to perform a rotating operation to rotate the stirring member, wherein in the rotating operation, the control portion controls the motor such that a rotation direction of the stirring member is changed from the first rotation direction to the second rotation direction; and a detection unit that detects a rotation state of the motor, wherein the control portion determines whether to end the rotating operation or not based on the rotation state detected by the detection unit, and wherein the rotation state includes a rotation speed or a rotation amount of the motor.

2. The image forming apparatus according to claim 1, wherein the control portion is configured to end the rotating operation in a case where (i) the rotation speed or the rotation amount detected by the detection unit maintains at least a predetermined rotation speed or rotation amount, or (ii) the rotation speed or the rotation amount detected by the detection unit maintains a predetermined range of the rotation speed or the rotation amount, while the stirring member is kept rotating in one rotation direction for a predetermined period.

3. The image forming apparatus according to claim 2, wherein the control portion alternately changes the rotation direction of the stirring member, until (i) the rotation speed or the rotation amount detected by the detection unit maintains at least a predetermined rotation speed or rotation amount, or (ii) the rotation speed or the rotation amount detected by the detection unit maintains a predetermined range of the rotation speed or the rotation amount.

4. The image forming apparatus according to claim 3, wherein when a number of times of changing the rotation direction exceeds a predetermined number of times, an error message is displayed.

5. The image forming apparatus according to claim 1, wherein the toner storing portion is configured as a toner cartridge, so as to be attached to or detached from an apparatus main body of the image forming apparatus.

6. The image forming apparatus comprising:

a toner storing portion that stores toner;

a stirring member configured to stir the toner by rotating inside the toner storing portion;

a driving unit that includes a motor and is capable of rotating the stirring member in a first rotation direction and in a second rotation direction, which is an opposite direction to the first rotation direction, by a driving force of the motor;

a control portion configured to control the motor to perform a rotating operation to rotate the stirring member, wherein in the rotating operation, the control portion controls the motor such that a rotation direction of the stirring member is changed from the first rotation direction to the second rotation direction;

a detection unit that detects a rotation state of the motor; and a seal member which seals an opening of the toner storing portion and a part of which is fixed to the stirring member, wherein the control portion determines whether to end the rotating operation or not based on the rotation state detected by the detection unit, and wherein the control portion executes a seal removal operation, which removes the seal member from the opening by rotating the stirring member, after the rotating operation.

7. The image forming apparatus according to claim 6, wherein the control portion sets a first rotation direction of the stirring member in the rotating operation to the same direction as the rotation direction of the stirring member in the seal removal operation.

8. The image forming apparatus according to claim 7, wherein in a case where the rotation direction of the stirring member in the rotating operation is an opposite direction to the rotation direction of the stirring member in the seal removal operation, the control portion does not determine whether to end the rotating operation or not.

9. The image forming apparatus according to claim 8, wherein the control portion starts the seal removal operation without stopping the rotation of the stirring member.

10. The image forming apparatus according to claim 6, wherein in the rotating operation, the motor rotates the stirring member in a range where the seal member is not removed from the opening by the rotation of the stirring member.

11. An image forming apparatus comprising:

a toner storing portion that stores toner;

a stirring member configured to stir the toner by rotating inside the toner storing portion;

a driving unit that includes a motor and is capable of rotating the stirring member in a first direction and in a second direction, which is an opposite direction to the first direction, by a driving force of the motor; and a control portion configured to control the motor such that a rotation direction of the stirring member changes between the first direction and the second direction if a rotation speed of the motor does not reach a predetermined speed or a rotation amount of the motor does not reach a predetermined amount.

12. The image forming apparatus according to claim 11, wherein the control portion is configured to control the motor such that the stirring member is kept rotating in one rotation direction for a predetermined period if the rotation speed of the motor reaches the predetermined speed or the rotation amount of the motor reaches the predetermined amount.

13. The image forming apparatus according to claim 12, wherein when a number of times of changing the rotation direction exceeds a predetermined number of times, an error message is displayed.

14. The image forming apparatus according to claim 11, further comprising: a seal member which seals an opening of the toner storing portion and a part of which is fixed to the stirring member such that the seal member is removed from the opening by rotating the stirring member.

15. The image forming apparatus according to claim 14, wherein the seal member is removed from the opening by rotating the stirring member in the first direction.

16. The image forming apparatus according to claim 15, wherein the control portion is configured to control the motor to perform (i) a first rotating operation to rotate the stirring member in the first direction at a first speed, and (ii) a second rotation operation to rotate the stirring member in the first direction at a second speed faster than the first speed, and the second rotation operation is performed after the first rotation operation.

17. The image forming apparatus according to claim 16, wherein the seal member is removed from the opening by the second rotation operation.

18. The image forming apparatus according to claim 16, wherein the control portion is configured to control the motor to perform a third rotating operation to rotate the stirring member in the second direction, and the third rotation operation is performed after the first rotation operation and before the second rotation operation.

19. The image forming apparatus according to claim 18, wherein the seal member is removed from the opening by the second rotation operation.

* * * * *